US006045401A

United States Patent [19]

McAlonis

[11] Patent Number: 6,045,401

[45] Date of Patent: Apr. 4, 2000

[54] CONNECTOR-MOUNTING MEMBER

[75] Inventor: Matthew Richard McAlonis, Wrightsville, Pa.

[73] Assignee: The Whitaker Corporation, Wilmington, Del.

[21] Appl. No.: 08/939,037

[22] Filed: Sep. 26, 1997

[51] Int. Cl.[7] ..... H01R 13/60

[52] U.S. Cl. ..... 439/567; 439/540.1; 439/541.5

[58] Field of Search ..... 439/567, 540.1, 439/541.5, 542, 543, 544, 552, 554, 555, 557, 562, 566, 569, 570, 571, 572, 573, 81, 82, 83

[56] References Cited

U.S. PATENT DOCUMENTS

| | | | |
|---|---|---|---|
| 4,416,496 | 11/1983 | Brefka | 339/17 C |
| 4,911,659 | 3/1990 | Viselli | 439/570 |
| 5,197,900 | 3/1993 | Ellis et al. | 439/352 |
| 5,288,244 | 2/1994 | Lien | 439/367 |
| 5,391,091 | 2/1995 | Nations | 439/378 |
| 5,807,135 | 9/1998 | Clark | 439/567 |

*Primary Examiner*—Paula Bradley
*Assistant Examiner*—Alexander Gilman

[57] ABSTRACT

A connector-mounting member (10) for mounting to a housing (44) of a connector (40) and for mounting the connector (40) to a circuit board (60) which comprises an L-shaped metal member (10) having a first leg (12) and a second leg (14), a jack screw-engaging section (16) extending outwardly from first leg (12) for insertion through a hole (46) in housing (44) and including a securing portion (18) for frictionally engaging hole (46) to secure connector-mounting member (10) on housing (44) and a jack screw-engaging portion (20) extending outwardly from a front surface of housing (44) for engagement with a mating jack screw, and a board-mounting portion (30) provided by the second leg (14) for mounting the connector (40) to circuit board (60).

17 Claims, 3 Drawing Sheets

CONNECTOR-MOUNTING MEMBER

FIELD OF THE INVENTION

The present invention relates to electrical connectors and more particularly to connector-mounting members.

BACKGROUND OF THE INVENTION

Conventional connector-mounting members typically comprise L-shaped metal brackets, bolts that extend through holes in legs of the L-shaped brackets extending along flanges that extend outwardly from sides of a connector housing, nuts that are threadable onto the bolts to secure the L-shaped brackets to the housing flanges, and board mounting members that extend through holes in the other legs of the L-shaped brackets for engaging through-holes in a circuit board thereby mounting the connector onto the circuit board.

These conventional mounting members use a large number of parts in addition to requiring assembly of the parts. This increases the cost of board-mounted connectors due to the number of parts as well as the cost of assembly.

U.S. Pat. No. 4,911,659 discloses connector-mounting members in the form of metal L-shaped members of the same configuration, each including internal screw-threaded shanks projecting from the upwardly-directed legs of the L-shaped members and holes in the other legs of the L-shaped members whereby the shanks have retention ribs on exterior surfaces for retaining the L-shaped members onto side flanges of a connector housing when the shanks are forcefully inserted into holes of the side flanges. Locking clips are inserted into the holes of the other legs of the L-shaped members for engagement with through-holes of a circuit board for mounting the connector housing to the circuit board.

The drawbacks of the connector-mounting members of the above patent are as follows: the connector-mounting members have the same configuration wherein the internal screw-threaded shanks mate with male jack screws, which is not acceptable under current ISO/IEC Standards; the retaining ribs may not securely retain the connector-mounting members at their proper orientation; and locking clips are required to mount the connector to a circuit board.

SUMMARY OF THE INVENTION

The present invention overcomes the drawbacks of the above known connector-mounting members by providing a one-piece connector-mounting member thereby substantially reducing the number of parts and eliminating the assembly of such numerous parts which will reduce the cost of manufacturing the connectors. The present invention also complies with current ISO/IEC Standards.

The present invention is realized by a connector-mounting member comprising an L-shaped member having a first leg and a second leg, a jack screw-engaging section extending outwardly from the first leg for insertion through a hole in a connector housing, the jack screw-engaging section including a securing portion for frictionally engaging the hole to secure the L-shaped member on the connector housing and a jack screw-engaging portion extending outwardly from a front surface of the housing for engagement with a matable jack screw.

The second leg of the L-shaped member can be provided with spaced lugs for friction engagement with a plated through-hole to mount the connector housing to a circuit board, or with an aperture for receipt of a fastener therethrough.

The connector-mounting members are preferably provided with anti-rotation members to prevent rotation of the connector-mounting member relative to the connector housing.

BRIEF DESCRIPTION OF THE DRAWINGS

Embodiments of the present invention will now be described by way of example with reference to the accompanying drawings in which.

DETAILED DESCRIPTION OF THE INVENTION

Figure 1:
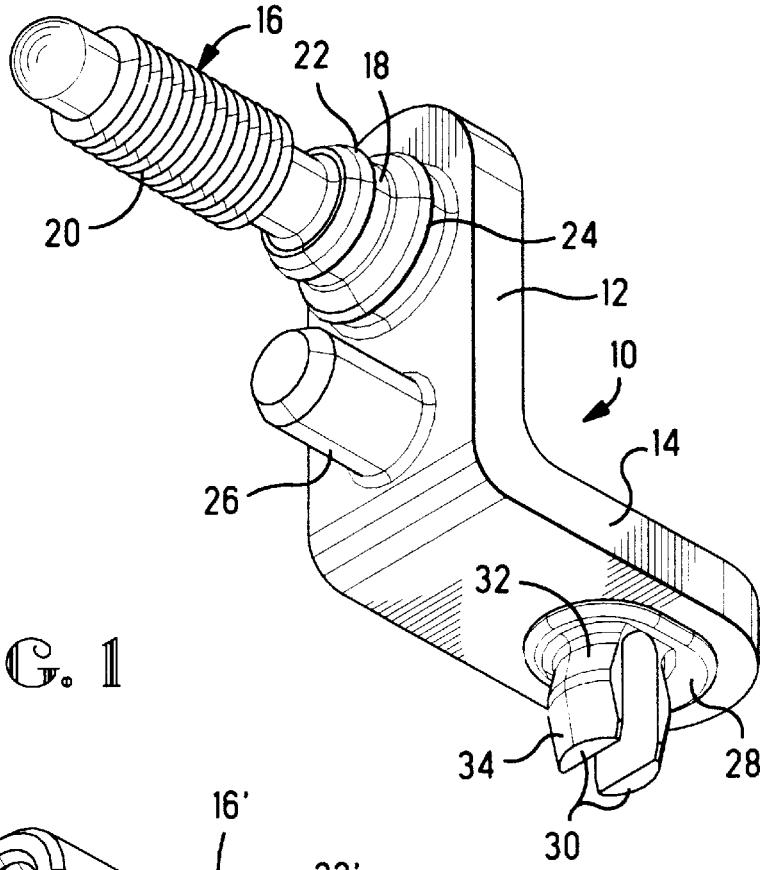
FIG. 1 is a perspective view of a connector-mounting member.
Figure 3:
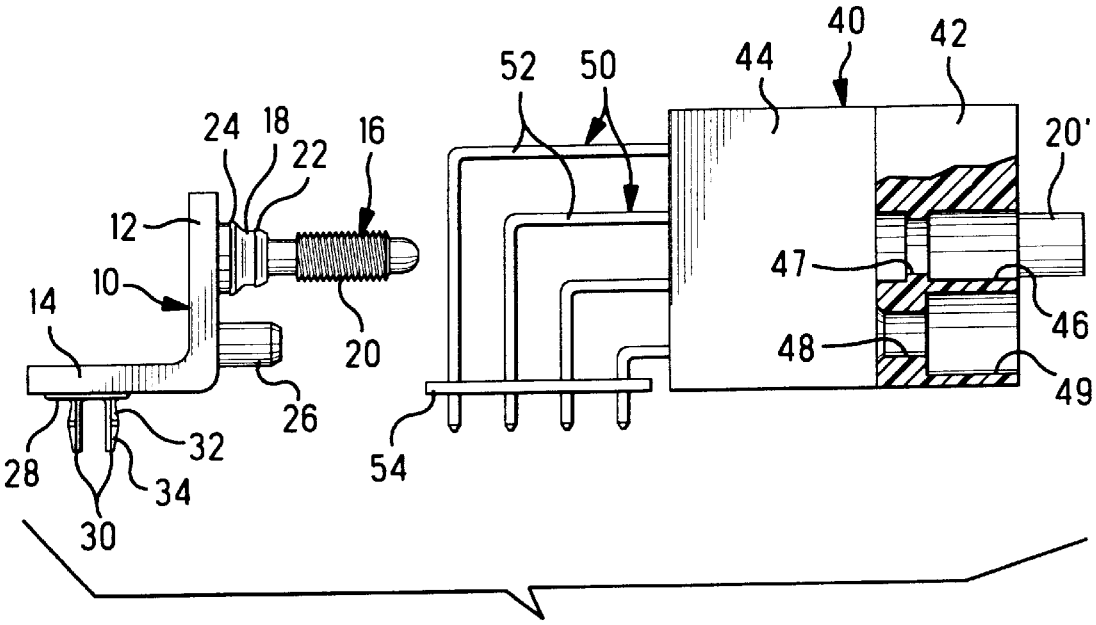
FIG. 3 is an exploded view showing the connector-mounting member exploded from a connector housing to which the connector-mounting member is to be mounted.
Figure 4:
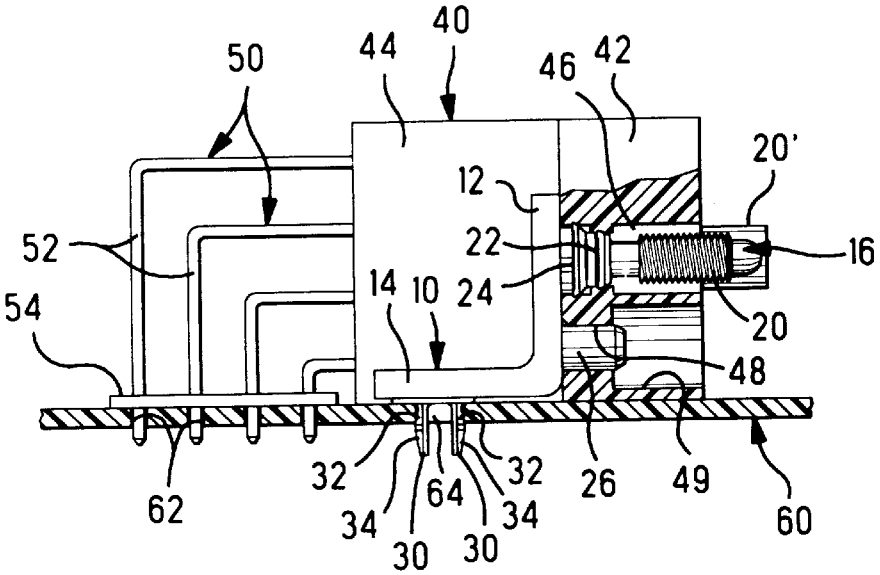
FIG. 4 is a view similar to FIG. 3 showing the connector-mounting member mounted to the connector housing and the connector mounted onto a circuit board.

FIGS. 1, 3 and 4 show a connector-mounting member 10, which is typically defined as a board mount for mounting electrical connectors onto a circuit board. Connector-mounting member 10 is formed from a suitable metal, such as zinc, in accordance with conventional metal die-casting practices and has an L-shaped configuration including a first leg 12 and a second leg 14.

First leg 12 includes a jack screw-engaging section 16 extending outwardly therefrom. Jack screw-engaging section 16 includes a securing portion 18 and a jack screw-engaging portion 20. Securing portion 18 has spaced annular projections 22,24. Annular projections 22,24 have forward tapered surfaces and rear vertical surfaces thereby defining annular barbs. Annular projection 22 has a smaller diameter than annular projection 24. Jack screw-engaging portion 20 is threaded and extends outwardly from securing portion 18 centrally thereof and constitutes a fixed male jack screw.

Anti-rotation member 26 extends outwardly from first leg 12 downwardly from jack screw-engaging section 16 and parallel thereto. Anti-rotation member 16 has a length substantially less than that of jack screw-engaging section 16.

Second leg 14 of connector-mounting member 10 has an oval projection 28 extending outwardly from a bottom surface adjacent an outer end thereof. Spaced lugs 30 extend outwardly from oval projection 28 and outer surfaces of lugs 30 have inner and outer tapered arcuate surfaces 32,34.

Figure 2:
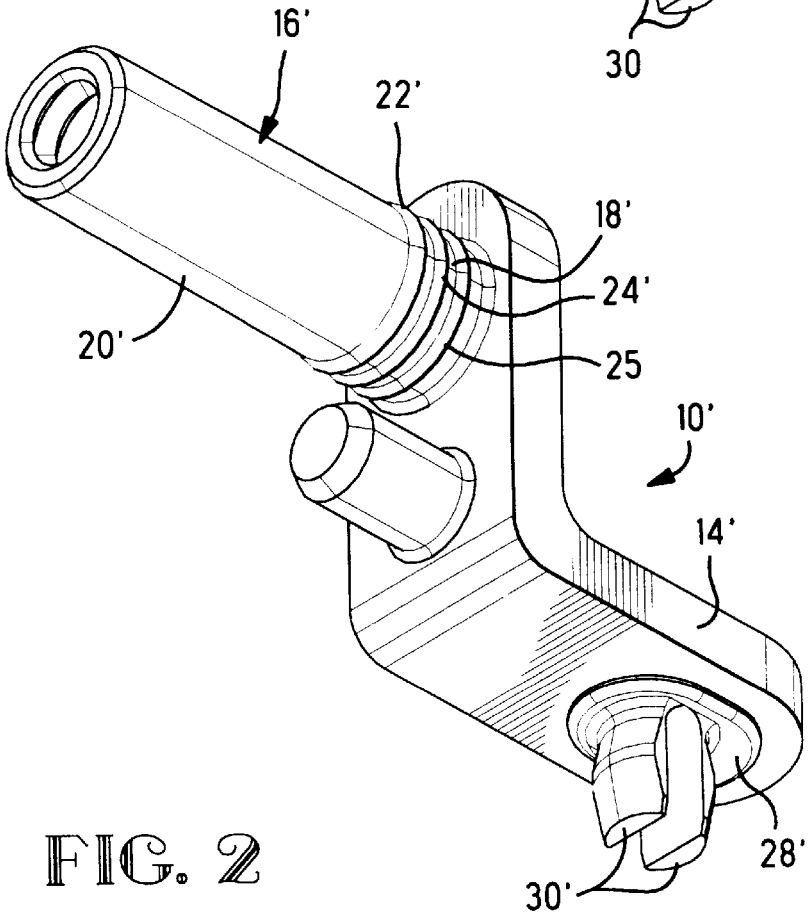
FIG. 2 is a perspective view of an alternative embodiment of the connector-mounting member.

FIG. 2 shows connector-mounting member 10'; which is an alternative embodiment; and it is substantially the same as connector-mounting member 10 except for jack screw-engaging section 16'. Connector-mounting member 10' constitutes a fixed female jack screw. Other than this, the connector-mounting members 10,10' are the same. Jack screw-engaging section 16' also includes securing portion 18' and jack screw-engaging portion 20'. Securing portion 18' has spaced annular projections 22',24',25 of the same configuration as that of annular projections 22,24, and the diameter of annular projection 25 is greater than that of annular projection 24' which in turn is greater than that of annular projection 22'. Jack screw-engaging portion 20' has internal threads therealong which are preferably formed by rolling. Projections 22,24,22',24',25 can be separated into segments instead of being annular if desired.

After connector-mounting members 10,10' are die cast, they are then copper plated, nickel plated and tin-lead plated in accordance with conventional plating practices.

FIGS. 3 and 4 show the mounting of connector-mounting member 10 to a flange 42 of dielectric-housing 44 of electrical connector 40. Flange 42 has hole 46 extending there-through as well as hole 48 disposed downwardly from hole 46 and parallel thereto. An annular projection 47 is located adjacent an inner end of hole 46. The inner section of hole 46 has the same diameter as the outer section which has a much longer length than the inner section. Hole 48 has an inner section of smaller diameter than an outer section 49.

Electrical connector 40 has electrical contact sections (not shown) of electrical contacts 50 disposed in passageways (not shown) of housing 44. Right angle posts 52 of electrical contacts 50 extend outwardly from a rear surface of housing 44 and their free ends extend through respective holes in a dielectric plate 54 thereby aligning the free ends in rows for disposition in respective plated through-holes 62 of a circuit board 60 when the connector 40 is positioned thereon.

Jack screw-engaging section 16 and anti-rotation member 26 of connector-mounting member 10 are inserted into holes 46, 48 of flange 42 until leg 12 engages an inner surface of flange 42 as shown in FIG. 4. Annular barb 22 frictionally engages an inner surface of annular projection 47 of hole 46 whereas annular barb 24 frictionally engages the inner section of hole 46 thereby securing connector-mounting member 10 in position on flange 42 of housing 44 as shown in FIG. 4 which also shows lugs 30 disposed in plated through-hole 64 of circuit board 60. Preferably, anti-rotation member 26 extends farther forwardly than forwardmost annular projection 22,22' (best seen in FIG. 3) to enter hole 48 first and thus serve as an alignment member during assembly of the connector-mounting member into the housing, precisely aligning the two prior to engagement of the barbs with the side walls of holes 46.

During mounting of connector 40 to board 60, lugs 30 are aligned with board holes 64, and outer tapered arcuate surfaces 34 will initially engage sides of the holes 64 and deflect lugs 30 toward each other to pass through the holes. As can be seen from FIG. 4, inner tapered arcuate surfaces 32 frictionally engage through-hole 64 thereby maintaining connector 40 in position on circuit board 60 whereafter lugs 30 and posts 52 are soldered to the respective plated through-holes 62,64 by flow soldering or reflow soldering.

A front end portion of jack screw-engaging portion 20 extends outwardly from a front surface of housing 44 for matable engagement with a rotatable female jack screw of a matable connector (not shown) for securing the connectors together.

Connector-mounting member 10' is securely mounted into another flange on the other side of housing 44 in the same manner as connector-mounting member 10 except that the hole for receiving jack screw-engaging portion 20' has the same diameter therealong and annular barbs 22',24',25 bite into the wall of the hole thereby securing connector-mounting member 10' in position on the other flange with a front end portion of jack screw-engaging portion 20' extending outwardly from the front surface of housing 44 (see FIGS. 3, 4) for matable engagement with a rotatable male jack screw of the matable connector (not shown). Lugs 30' of connector-mounting member 10' also are disposed in a plated through-hole of circuit board 60. Projections 28,28' of connector-mounting members 10,10' engage an upper surface of the circuit board 60 thereby enabling debris to be cleaned therefrom.

Connector-mounting member 10 is located at the left flange whereas connector-mounting member 10' is located at the right flange. Such an arrangement is in accordance with ISO/IEC Standard 2593. Connector-mounting member 10' cannot be mounted on the left flange because the outside diameter of jack screw-engaging portion 201 cannot be completely inserted into stepped hole 46.

Figure 5:
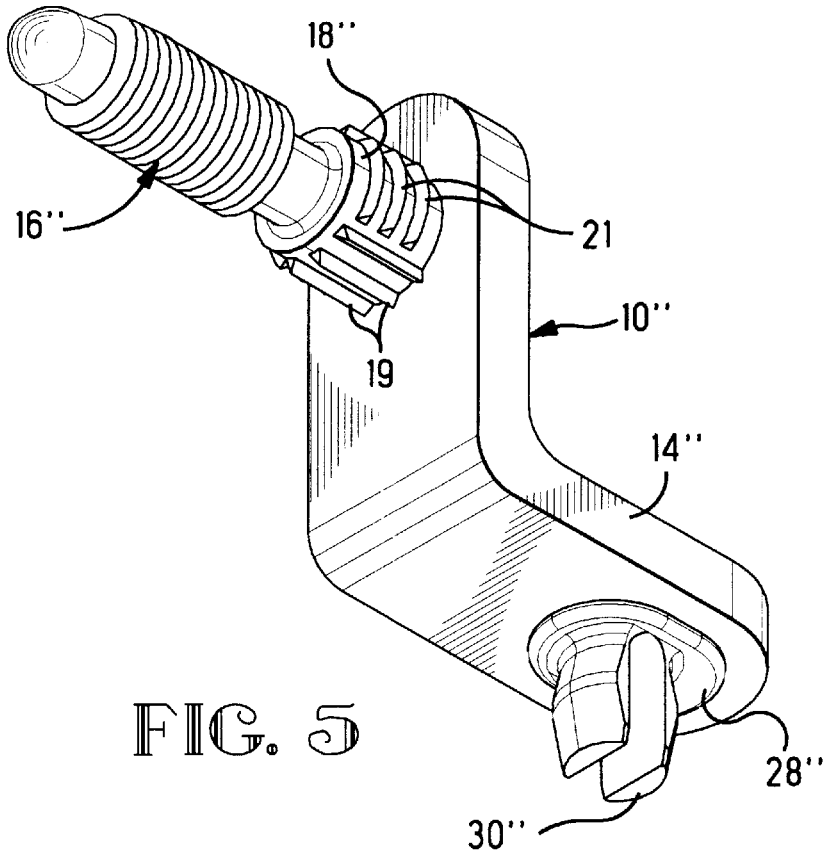
FIG. 5 is a perspective view of another embodiment of the connector-mounting member.

FIG. 5 shows connector-mounting member 10", another embodiment of the invention. Connector-mounting member 10" is the same as connector-mounting member 10 except that securing portion 1811 includes alternating sections having horizontal triangular-shaped ribs 19 and vertical triangular-shaped ribs 21 which bite into the inner section of stepped hole 46 of the flange 42 of housing 44 when jack screw-engaging section 16" is inserted into hole 46. Securing portion 18" can also replace securing portion 18' of connector-mounting member 10' to secure connector-mounting member 10' on the other flange of the housing 44. Ribs 19 prevent rotation of the connector-mounting members.

Figure 6:
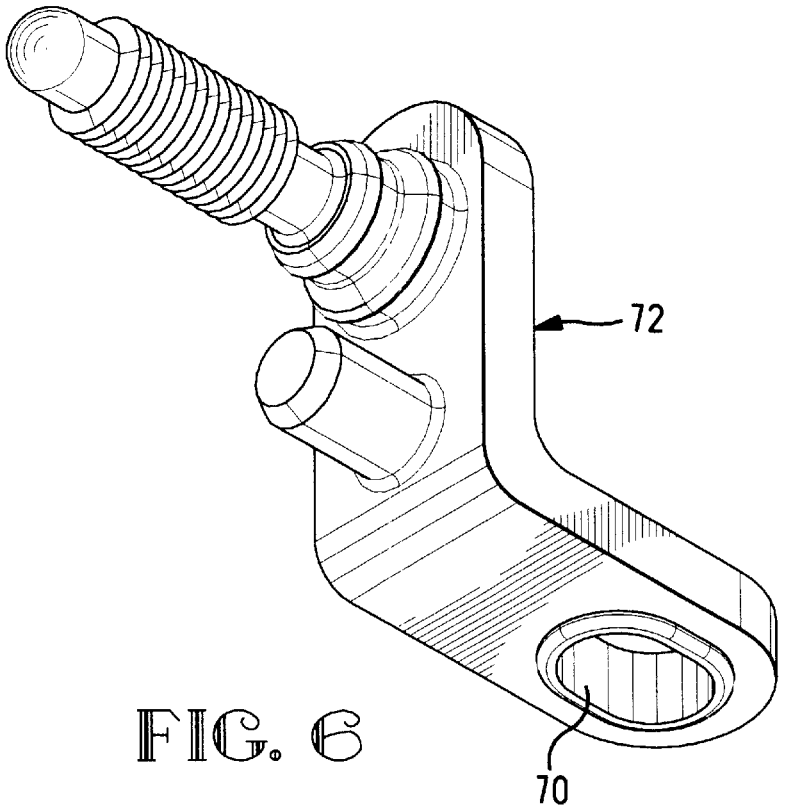
FIG. 6 is a part perspective view of a further embodiment of the connector-mounting member.

Lugs 30,30',30" can be replaced in legs 14,14',14" of connector-mounting members 10,10',10" by an oblong hole 70 in connector-mounting member 72 (FIG. 6) through which a threaded shank of a bolt can extend for engagement with plated through-holes 64 in circuit board 60 for mounting connector 40 thereon.

The connector-mounting members of the invention can be electrically connected to a metal shield on housing 44 for providing a ground connection.

An advantage of the present invention include an integral connector-mounting member for mounting onto a connector housing of a connector and for mounting the connector to a circuit board thereby substantially reducing parts and eliminating assembly time. The connector-mounting members can be automatically mounted onto the connector housings. Anti-rotation members prevent rotation of the connector-mounting members, and also serve to align the jack-screw-engaging sections during connector assembly.

What is claimed is:

1. A connector-mounting member for mounting to a housing of a connector and for mounting the connector to a circuit board, comprising:

a one-piece L-shaped member having a first leg and a second leg;

a jack screw-engaging section extending outwardly from the first leg for insertion through a hole in the housing and including a securing portion for frictionally engaging the hole to secure the L-shaped member on the housing and a jack screw-engaging portion extending outwardly from a front surface of the housing and being nonrotatable during threaded engagement with a matable rotatable jack screw; and a board-mounting portion provided by the second leg for mounting the connector to the circuit board; and an anti-rotation member extending outwardly from the first leg, parallel to the hole in the housing to prevent rotation of the L-shaped member after being securely mounted to the housing.

2. A connector-mounting member as claimed in claim 1, wherein the securing portion has at least one connector retention projection.

3. A connector-mounting member as claimed in claim 1, wherein the jack screw-engaging portion extends outwardly from the securing portion and has threads defining a fixed male jack screw.

4. A connector-mounting member as claimed in claim 1, wherein the jack screw-engaging portion extends outwardly from the securing portion and has internal threads defining a fixed female jack screw.

5. A connector-mounting member as claimed in claim 1, wherein the board-mounting portion is in the form of an oblong hole extending through the second leg.

6. A connector-mounting member as claimed in claim 1, wherein an alignment member on the first leg cooperates with the housing during connector assembly to align the L-shaped member prior to retentive engagement by retention sections of the L-shaped member with the housing.

7. A connector-mounting member as claimed in claim 1, wherein an anti-rotation section of said jack screw-engaging section cooperates with said housing to prevent rotation of the L-shaped member after being securely mounted to the housing.

8. A connector-mounting member as claimed in claim 1, wherein the board-mounting portion comprises spaced lugs integral with and extending outwardly from a bottom surface of said second leg for frictional engagement with a plated through-hole in the circuit board.

9. A connector-mounting member as claimed in claim 8, wherein the spaced lugs have inner and outer tapered arcuate surfaces.

10. A connector-mounting member as claimed in claim 8, wherein a projection is disposed between the bottom surface of the second leg and the spaced lugs.

11. An electrical connector comprising:

an insulative housing having mating face, an opposed assembly face and a board-mount face orthogonal thereto for mounting to a circuit-bearing substrate, and containing at least one electrical contact extending from said mating face to said board-mount face, said housing including first and second mounting flanges at opposed ends thereof having first and second holes therethrough respectively; and first and second L-shaped members securable to said housing, each having a first leg and a second leg and having a jack screw-engaging section extending outwardly from the first leg for insertion through one of said first and second holes to a jack screw-engaging portion extending outwardly from said mating face of the housing for engagement with a matable jack screw, and further having a board-mounting portion provided by the second leg for mounting the connector to the circuit-bearing substrate, said jack screw-engaging portion of said first L-shaped member is a shaft having external threads defining a fixed male jack screw, and said jack screw-engaging portion of said second L-shaped member is apertured and has internal threads defining a fixed female jack screw and is larger in diameter than said jack screw-engaging portion of said first L-shaped member, said first L-shaped member includes a first securing portion rearwardly from said jack screw engaging portion thereof for frictionally engaging said first hole to secure the L-shaped member on the housing, and said second L-shaped member including a second securing portion rearwardly from said jack screw engaging portion thereof for frictionally engaging said second hole to secure the L-shaped member on the housing, and said first hole having a constriction therealong smaller in diameter than said jack-screw-engaging portion of said second L-shaped member, and said first securing portion has a diameter at least at the forward end thereof corresponding to said constriction to frictionally engage said constriction, for assuring that only said first L-shaped member is insertable into said first hole and securable to said first mounting flange.

12. The connector as set forth in claim 11 wherein said first leg of at least one of said first and second L-shaped members has an anti-rotation member extending outwardly therefrom parallel to said jack screw-engaging section for disposition in another hole in the housing to prevent rotation of the L-shaped member after being securely mounted to the housing.

13. The connector as set forth in claim 11 wherein the board-mounting portion of at least one of said first and second L-shaped members comprises spaced lugs integral with and extending outwardly from a bottom surface of said second leg for frictional engagement with a plated through-hole in the circuit board.

14. A connector-mounting member for mounting to a housing of a connector and for mounting the connector to a circuit board, comprising:

a one-piece L-shaped member having a first leg and a second leg;

a jack screw-engaging section extending outwardly from the first leg for insertion through a hole in the housing, the jack screw-engaging section including a securing portion for frictionally engaging the hole to secure the L-shaped member on the housing, the securing portion having spaced projections that are annular and have beveled outer surfaces and vertical inner surfaces defining barbs and a jack screw-engaging portion extending outwardly from a front surface of the housing and being non-rotatable during threaded engagement with a matable rotatable jack screw; and a board-mounting portion provided by the second leg for mounting the connector to the circuit board.

15. A connector-mounting member as claimed in claim 14, wherein the spaced projections include an outer projection and an inner projection with the outer projection having a diameter smaller than the inner projection.

16. A connector-mounting member as claimed in claim 14, wherein the spaced projections include an outer projection, an intermediate projection and an inner projection with the outer projection having a diameter smaller than the intermediate projection and the outer projection and the intermediate projection having a diameter smaller than the inner projection.

17. A connector-mounting member as claimed in claim 14, wherein the spaced projections include horizontal ribs and vertical ribs.

* * * * *